United States Patent [19]

Eberhardt

[11] Patent Number: 4,553,902

[45] Date of Patent: Nov. 19, 1985

[54] FLOATING PORTABLE PUMP

[75] Inventor: H. Alfred Eberhardt, Paoli, Pa.

[73] Assignee: Hale Fire Pump Co., Conshohocken, Pa.

[21] Appl. No.: 601,582

[22] Filed: Apr. 18, 1984

[51] Int. Cl.[4] ..... F04B 49/00; F04B 21/00; F04B 17/00

[52] U.S. Cl. ..... 417/34; 417/61; 417/234; 417/363; 417/364; 415/7; 123/334; 123/392

[58] Field of Search ..... 417/34, 61, 234, 313, 417/337, 363, 364; 415/7; 416/84–86; 123/334, 392; 60/320, 321; 239/182

[56] References Cited

U.S. PATENT DOCUMENTS

| | | | |
|---|---|---|---|
| 1,517,635 | 12/1924 | Junkers | 60/321 |
| 1,920,371 | 8/1933 | Franke | 415/7 X |
| 2,373,143 | 4/1945 | Samiran | 417/34 X |
| 2,634,681 | 4/1953 | Rowell | 417/34 |
| 2,656,827 | 10/1953 | Conover | 123/334 |
| 2,943,592 | 7/1960 | Benson et al. | 60/320 X |
| 3,266,428 | 8/1966 | Feith et al. | 417/234 X |
| 3,273,507 | 9/1966 | Handford | 417/61 |
| 3,393,643 | 7/1968 | Herman | 416/85 |
| 3,397,647 | 8/1968 | Daniel | 417/61 X |
| 3,398,878 | 8/1968 | Quiram et al. | 417/61 |
| 3,400,664 | 9/1968 | Kingsep | 415/7 |
| 3,470,822 | 10/1969 | Evans et al. | 417/61 |
| 3,556,685 | 1/1971 | Moore | 417/337 |
| 3,612,721 | 10/1971 | Evans et al. | 417/61 |
| 3,617,146 | 11/1971 | Garland | 415/7 |
| 3,796,515 | 3/1974 | Lindqvist et al. | 417/34 X |
| 3,926,537 | 12/1975 | Piper | 417/363 X |

FOREIGN PATENT DOCUMENTS

| | | | |
|---|---|---|---|
| 188221 | 1/1957 | Austria | 417/61 |
| 906835 | 8/1972 | Canada | 417/61 |
| 2926494 | 1/1981 | Fed. Rep. of Germany | 415/7 |
| 64160 | 5/1980 | Japan | 123/334 |
| 382848 | 9/1973 | U.S.S.R. | 415/7 |

*Primary Examiner*—William L. Freeh
*Assistant Examiner*—Paul F. Neils
*Attorney, Agent, or Firm*—Charles S. McGuire

[57] ABSTRACT

A floating portable pump is constructed of a float defining a well for containing water, a centrifugal pump supported on the float with its impeller shaft extending vertically and with its suction inlet submerged in water in the well, and an internal combustion engine arranged to drive the pump impeller. The pump and engine are secured together on the float in an arrangement such that the engine causes rotation of the pump impeller to cause the pump to draw water from the well through its suction inlet and discharge water from the pump discharge.

12 Claims, 8 Drawing Figures

58
12
152
150
L
56
60
153
156
61
86
84
158
158
54
66
69
164
2
92
94
20
84
68
42
2
80
46
162
108
82
38
69
34
30
36
42
140
134
32
7
130
16
47
7
31
14
136
138
132
18
10

FIG.5
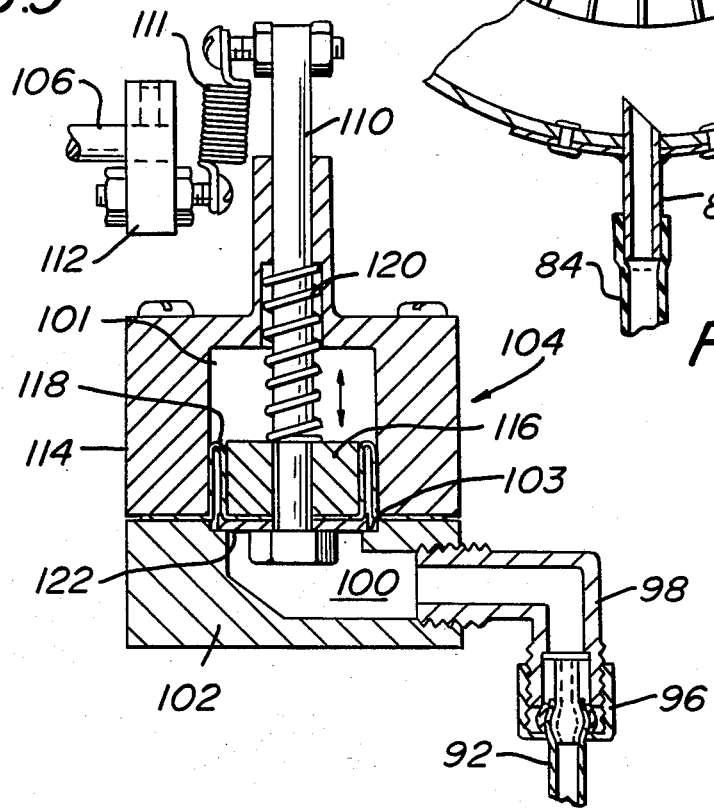
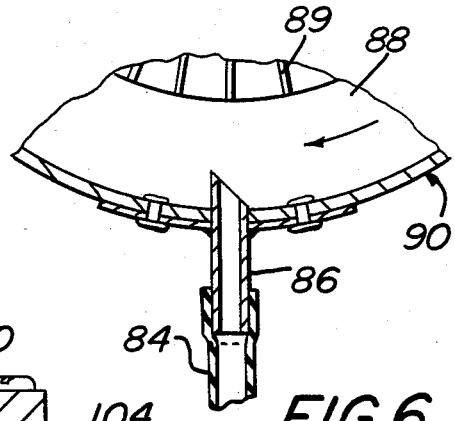
FIG.6
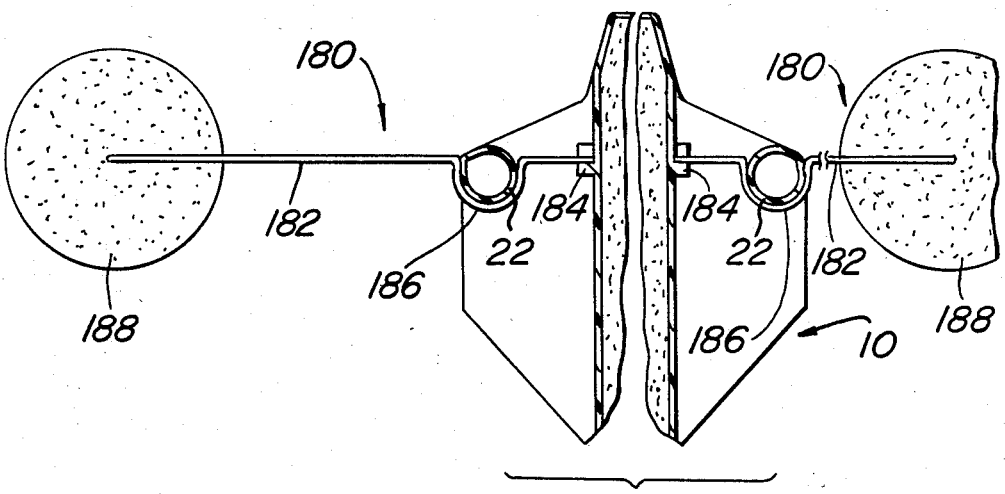
FIG.8

FLOATING PORTABLE PUMP

BACKGROUND AND SUMMARY OF THE INVENTION

This invention relates generally to a floating portable pump of the type capable of being used in remote and relatively inaccessive locations and with a minimum of water depth. More particularly, the pump in accordance with the invention is particularly adapted for use in fire-fighting applications.

Floating pumps are known. Typical of such pumps are the floating pumps disclosed in U.S. Pat. Nos. 3,397,647; 3,273,507; 3,400,664; and 3,470,822.

Fires occur at locations that are not within reach of pumpers or large portable firefighting equipment. For example, they occur in the woods, in remote mountain cabins, on board cabin cruisers or in the middle of a marina. Moreover, often a fire occurs at a location where there is only a small depth of water available to the fire fighter.

It is the general object of the invention to provide a floating portable pump which is capable of pumping a sufficient volume of water for putting out a remotely located fire from a water supply having a minimum depth.

In accordance with the general object of the invention the floating portable pump of the invention is constructed with a minimum of weight so that it can be easily handled by just one person. There is provided an unsinkable float that is foam filled and has a high strength so that it can withstand long term wear and tear. Moreover, the float is compact and is provided with dual carrying handles and a splash suspension collar to protect the engine in rough water. Further, the floating portable pump of the invention is constructed so that it can be stored easily and vertically in various locations including a fire truck compartment.

In accordance with another feature of the invention there is provided a pressure governing system for automatic engine speed control and an electrically operated overspeed control whereby the pump is brought back down to idle speed in the event that the pump speed increases as a result of a clogging of the inlet screen or cavitation of the pump.

In accordance with other features of the invention the construction is such that no suction hose is required and there is provided an automatic prime valve means for immediately removing any entrapped air so as to ensure instant and complete priming.

In accordance with another feature of the invention, the pump is mounted on independent shock mounts so that the vibration from the engine will not in any way loosen the mounting of the pump and engine or damage the float itself. Moreover, this design involves a totally rubber suspension made of inexpensive parts.

Another feature of the invention is the provision of fins on the exhaust pipe casting to help cool the exhaust and the provision of splash plates on the engine to help cool the exhaust and protect the plastic float from high exhaust temperatures.

BRIEF DESCRIPTION OF THE DRAWINGS

FIG. 5 is a sectional view taken generally on line 5—5 of FIG. 2.

FIG. 6 is a sectional view taken generally on line 6—6 of FIG. 2.

FIG. 8 is a fragmentary view showing an outrigger attachment for the float.

DETAILED DESCRIPTION OF THE PREFERRED EMBODIMENT

Figure 4:
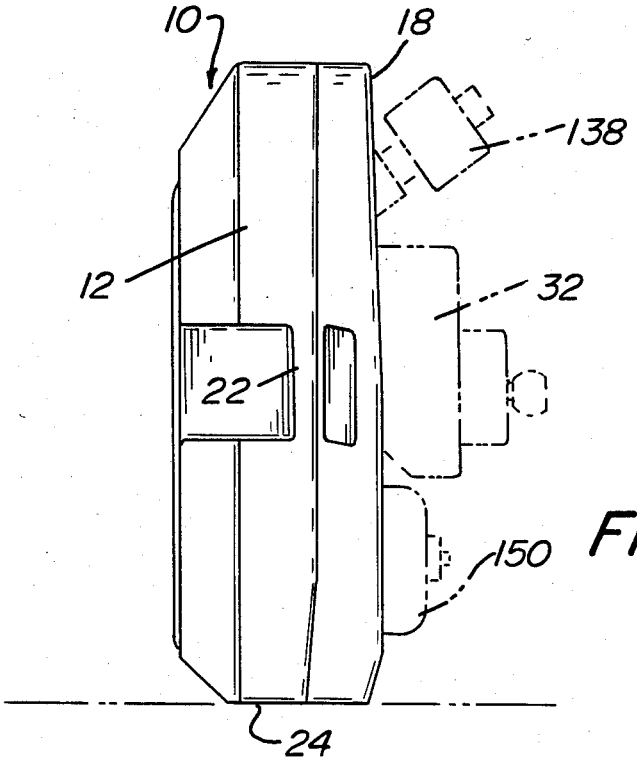
FIG. 4 is a view showing the float mounted in the vertically supported position.

The floating portable pump in accordance with the invention comprises a float 10 having an elongated configuration with a rim portion 12 enclosing an internal shelf 14 having a central opening 16 therein as is best shown in FIG. 4. Float 10 is made of a high strength plastic construction so that it can withstand long term wear and tear. To this end, float 10 is slush molded in a mold such that a hollow shell of high strength polyethylene is formed, after which is closed cell polyurethane foam is injected into the shell to fill the same. This method of plastic molding is well known in the art.

In accordance with a novel feature of the invention, float 10 is formed to provide a raised collar portion 18 extending upwardly from the rim portion 12 around the shelf 14 to provide a splash collar that protects the electrical parts of the engine supported on the float 10 from contact with water directed toward these parts by splashing and wave action.

The float 10 is provided with wall portions defining a well 20 for containing water when the float 10 is supported on water in a partially submerged floating condition.

In accordance with a novel feature of the invention, a pair of handles 22 are molded into opposite elongated sides of the rim portion 12 of the float 10. The handles 22 are located so that the float 10 can be carried easily by two persons on opposite sides thereof. The handles 22 also make it easier to place the float 10 in a desired position. Also, one end (termed the back end) of the float 20 is formed to provide a flat surface 24. This permits the float 10 to be stood up on this end as shown in FIG. 4 so as to be stored more easily in vertically extending compartments, such as those provided on fire trucks.

The shell forming the float 10 is made up in such a way that the bottom section 26 is thicker. By this construction, the float 10 will be more resistant to wear and tear in the bottom region thereof.

Figure 1:
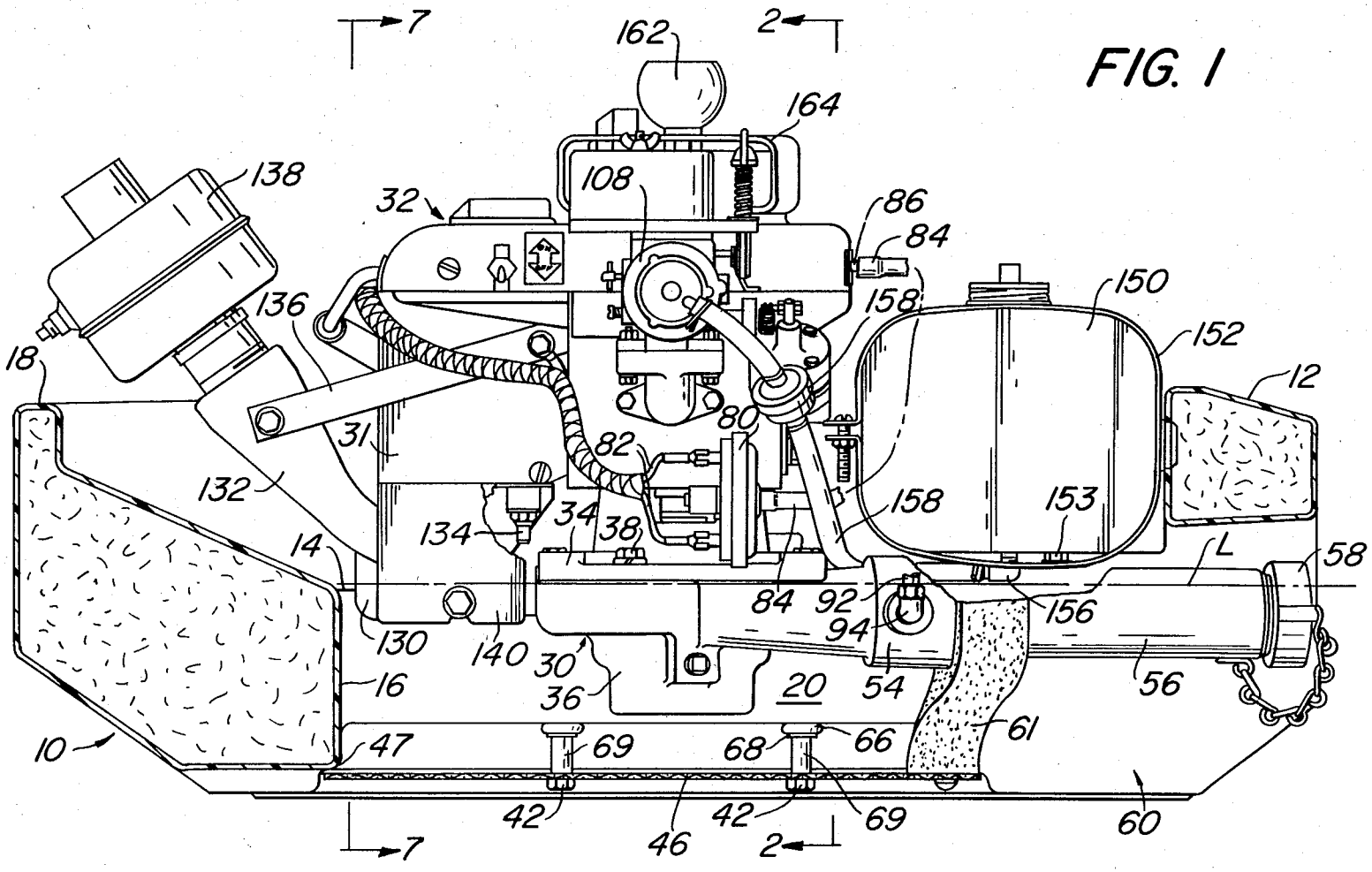
FIG. 1 is a side elevational view of the pump in accordance with the invention partly in section.
Figure 2:
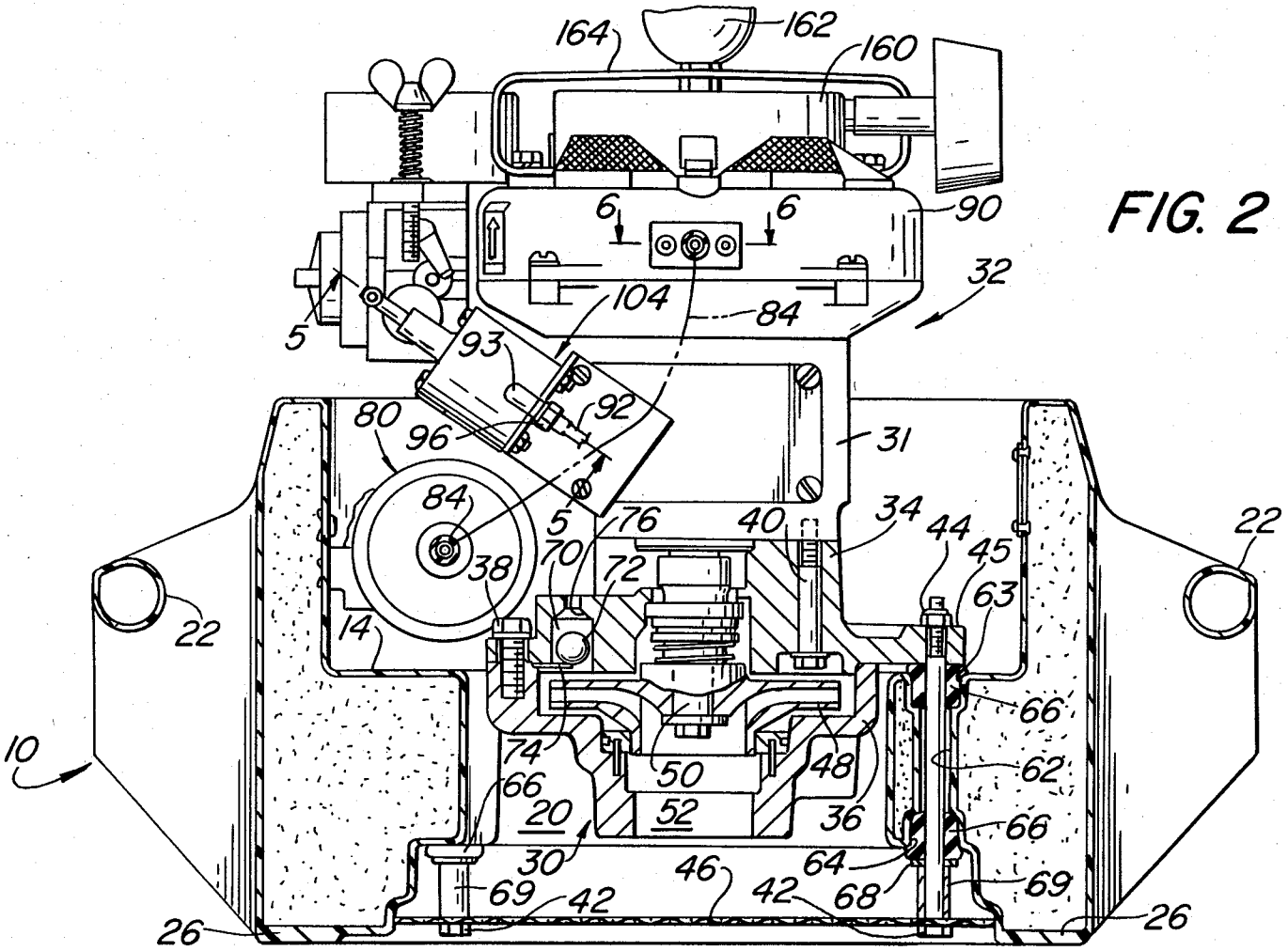
FIG. 2 is a sectional view taken generally on line 2—2 of FIG. 1.

A compact, light weight centrifugal pump 30 and a high speed internal combustion engine 32 are secured directly together and are supported as a unit on the float 10 in the arrangement shown in FIGS. 1 and 2 wherein the float 10 is shown in a horizontal position supported on water in a partially submerged floating condition, the water level being indicated at "L". For maximum speed and portability, engine 32 is a light weight 2-cycle air-cooled design. Pump 30 is comprised of an upper housing or pump head 34 and a lower housing 36 secured together by a plurality of bolts 38 which extend through holes in pump head 34 to threadedly engage lower housing 36. Pump 30 and engine 32 are secured together by a plurality of long screws 40 which extend through holes in pump head 34 to threadedly engage the block 31 of engine 32 as is shown in FIG. 2. The unit comprising pump 30 and engine 32 is supported on the shelf 14 of float 10 by a resilient mounting means to be described hereafter and is secured in position by four long bolts 42 which extend through aligned openings in the shelf portion 14 and a flange 45 on the pump head 34 for engagement with nuts 44, which mounting arrangement is best shown in FIG. 2. Bolts 42 also support the suction screen 46 of the portable pump as will be described more fully hereafter. Screen 46 extends across the float inlet opening 47 below the well 20.

The centrifugal pump 30 comprises an impeller 48 mounted on a rotatable impeller shaft 50, a suction inlet 52 and a pump discharge 54. With the float 10 in the floating condition shown in FIGS. 1 and 2, pump 30 is supported with its impeller shaft 50 extending vertically and with its suction inlet 52 submerged in water in the well 20. The impeller shaft 50 is an extension of the engine output shaft which extends through the pump 30 to have the impeller 48 mounted thereon for rotation therewith. As is apparent from FIGS. 1 and 2, the arrangement is such that operation of the engine 32 causes rotation of the impeller 48 to cause the pump 30 to draw water from the well 20 through the suction inlet 52 and to direct the water through the pump discharge 54. The pump discharge 54 delivers the water to a discharge tube 56 which is mounted on the open outlet end thereof to deliver the water from the well 20 to the back end of the float 10. The discharge tube 56 is provided with a cap 58 which is removable to permit connection of a suitable hose or the like to the tube 56 for conveying the pumped water to the firefighting location, as is conventional in firefighting applications.

The float 10 is provided with a passage 60 extending from the well 20 to the back end of the float 10 to accommodate the discharge tube 56. A foam plastic filler piece 61 is arranged to provide a strainer closure around tube 56 as it passes between well 20 and passage 60 to prevent debris from entering well 20 through passage 60. Inlet screen 46 prevents debris from entering well 20 through inlet opening 47 while permitting a sufficient volume of water to flow therethrough for the proper operation of pump 30.

Figure 3:
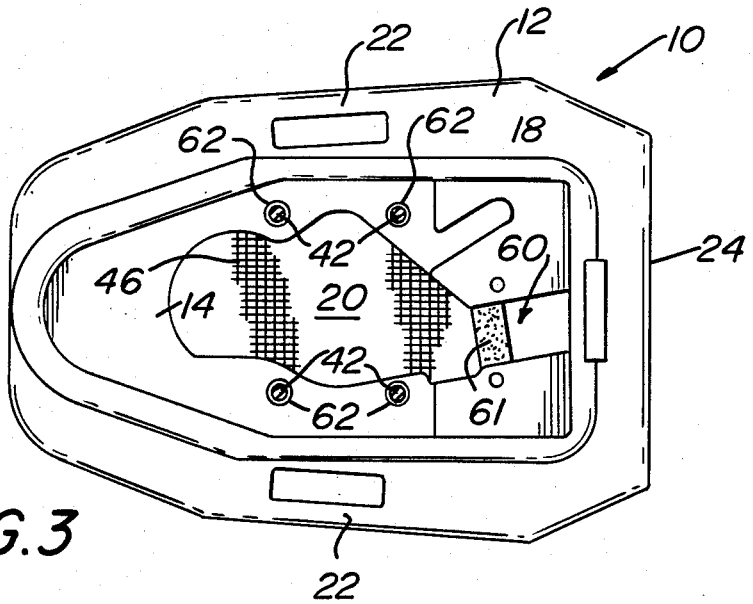
FIG. 3 is a plan view of the float incorporated in the pump in accordance with the invention.

In accordance with the invention there is provided a shock-absorbing mounting for the pump and engine unit on the float 10, which mounting is comprised of an inexpensive suspension construction entirely of rubber. The mounting comprises the four bolts 42 which extend through vertically extending passages 62 in the shelf 14 of float 10. The arrangement of the four passages 62 is shown in FIG. 3. Each of the passages 62 is provided at the ends thereof with upper and lower enlarged diameter portions 63 and 64, respectively, each of which is adapted to receive an annular shock absorbing member 66 mounted on the associated bolt 42, this arrangement being shown in FIG. 2. The shock absorbing members 66 are made of a resilient rubber, such as, for example, soft rubber having a durometer reading of 70. The upper member 66 of each mounting is in contact with the lower face of the flange 46 of the pump head 34 and the lower member 66 is in contact with a washer 68 positioned in contact with the upper end of a spacer sleeve 69 on bolt 42, the lower end of sleeve 69 being in contact with the suction screen 46 secured above the head of bolt 42. By this arrangement, the mounting members 66 are compressed into the enlarged diameter portions 63 and 64 in the float 10 by tightening of the nut 44 onto the upper end of bolt 42. As the nut 44 is screwed onto bolt 42, the bolt head is moved upwardly towards the bottom face of pump flange 45 whereby the mounting members 66 are caused to flow radially outwardly into contact with the walls of the upper and lower enlarged diameter portions 63 and 64 to be compressed therein and provide a resilient shock absorbing mounting for the engine-pump unit on the float 10. The mounting arrangement shown in detail in FIG. 2 is provided at each of the four locations on the bolts 42 to provide an evenly distributed shock absorbing mounting.

By using the compressed rubber mounting arrangement described above, the rubber mounting also minimizes the vibration of the plastic float 10 that would occur in the event the float 10 were resting on the bottom of a pond or the like. It will be apparent that if the engine-pump unit were mounted directly to the plastic float, there would be a tendency of the metal parts to wear the plastic resulting in a failure of the engine mounts. This is avoided by the mounting arrangement in accordance with the invention.

It will be apparent that when the portable pump of the invention is initially placed down on the water for use, air becomes trapped in the interior of pump 30 in the suction inlet 52 and the impeller chamber. As is well known, any air that becomes entrapped in the interior of a centrifugal pump tends to rush towards the eye of the impeller so that the pump never becomes completely primed. In order to obviate this problem, there is provided an automatic priming valve means which provides for the immediate and complete removal or escape of any air that should become entrapped in the interior of the centrifugal pump 30. Such means comprises a check valve located in a passage 70 formed in the pump head 34 and communicating at its lower open end with the volute of the pump 30 at a location above the impeller 48. The passage 70 extends vertically and its upper open end communicates with the exterior of the pump 30 above the water level "L" as is apparent from FIG. 2. The check valve comprises a ball 72 which is secured in the passage 70 by a small roll pin 74 which retains the ball 72 within the passage 70 as shown in FIG. 2. Ball 72 has a specific gravity greater than "1" so that it tends to sink in water. A valve seat 76 is formed in passage 70 near the upper end thereof and above ball 72 when it rests on pin 74. Movement of the ball 72 upwardly in the passage 70 into contact with seat 76 closes off flow through passage 70. By this check valve arrangement, any air in the interior of the pump 30 can pass through the passage 70 around the ball 72 and to the exterior of the pump 30 with the parts in the position as shown in FIG. 2. However, once the pump 30 is primed and in operation, water will rush upwardly through the passage 70 raising the ball 72 upwardly into contact with the valve seat 76 where it will be retained during the normal operation of the pump 30. With the ball 72 held against the valve seat 76, water flow through passage 70 is shut off and pumping pressure will be developed immediately whereby the pump 30 is primed automatically.

In accordance with the invention there is provided an engine overspeed control means which is responsive to the occurrence of an excessive engine speed and operates to short the ignition circuit for the engine 32 to limit the engine speed to a safe condition. An engine overspeed condition would occur if the portable pump were lifted out of the water or the water supply in the well 20 would disappear for any reason. If this should occur, it is possible that the engine speed will increase to an excessive amount and possibly cause damage to the engine 32. This "runaway" condition is a common problem with 2-cycle engines. The overspeed engine control means comprises an air switch 80 which is serially connected in the grounding circuit wires 82 for the engine ignition. Air switch 80 is of a well known type (available from Robertshaw Controls Co., Uni-Line Division, under the name SE8000 SINGLE LEVEL PRESSURE SWITCHES) and is operated by a small diaphragm which moves a switch contact between open and closed positions to open and close the grounding circuit for the engine ignition. The diaphragm chamber of the air switch 80 is connected by a hose 84 to an overspeed switch assembly nozzle 86 which is mounted to pick up the air flow pressure produced in the fan chamber 88 by a small fan 90 which is mounted on the flywheel of the engine 32. This fan 90 is conventionally provided in air-cooled engines and operates to blow air around the engine cylinders and over the fins on the cylinders to cool the engine. If the load suddenly is removed from the engine 32, as when the float is removed from the water, for example, then the fan speed increases. This results in a rapid increase of the air flow pressure sensed by the nozzle 86 since this pressure increases in proportion to the square of the RPM of the engine. This increase in pressure is transmitted by way of hose 84 to the diaphragm chamber of the air switch 80 to move the switch contact operated thereby to a closed position to ground the ignition circuit of engine 32 and hold back the engine speed so as to prevent it from reaching and staying at an undesirably high speed. The grounding and ignition circuits are conventional, one type being disclosed in the publication of the MARINE DIVISION OF CHRYSLER CORPORATION entitled "2-CYCLE POWER BEE ENGINES-SERIES 610 and 820 SERVICE MANUAL" dated June, 1981.

In accordance with another feature of the invention there is provided throttle actuator means for actuating the throttle means of engine 32 to reduce the engine speed to an idle condition in response to the sensing of a low water pressure condition in the pump discharge. To this end, there is provided means for sensing the pressure of the water in the pump discharge flow, such means comprising a conduit 92, such as nylon tubing, which is connected at one end to an elbow fitting 92 in flow communication with the downstream end of the pump discharge 54. The other end of the conduit 92 is connected to a tubing compression assembly 96 mounted on one end of an elbow fitting 98. The elbow fitting 98 provides communication between the conduit 92 and the pressure chamber 100 provided in the cover 102 of a throttle actuator assembly 104 as is shown in FIG. 5. The throttle actuator assembly 104 is connected to the throttle shaft 106 and causes rotation of the same to open and close the throttle in the carburetor 108 of the engine 32 as is well known in the art. The throttle actuator assembly 104 is connected to the throttle shaft 106 by means of a piston rod 110 which is connected by way of a tension spring 111 to an arm 112 secured on the end of throttle shaft 106 as is shown in FIG. 5. Movement of the piston rod 110 in the upward direction shown in FIG. 5 causes the throttle shaft 106 to be rotated to position the engine throttle in an open position. On the other hand, when the piston rod 110 is in the "rest" position shown in FIG. 5, the throttle shaft 106 is positioned to maintain the engine 32 in an idle condition. The throttle actuator assembly 104 comprises a housing 114 which is secured to the cover 102. The pressure chamber 100 is formed in the cover 102 below a cylindrical piston chamber 101 formed in the housing 114. Piston chamber 101 accommodates movement of a rolling diaphragm piston means comprising a piston 116 and a rolling diaphragm 118 secured on the lower end of the piston rod 110. The rolling diaphragm 118 is mounted in a "friction free" arrangement as shown in FIG. 5 and separates the piston chamber 101 and the pressure chamber 100. The "friction free" arrangement eliminates frictional sliding contact between the rolling diaphragm piston means and the wall of the piston chamber 101. An actuator spring 120 is positioned in compression between piston 116 and a shoulder formed in housing 114 to bias piston 116 downwardly to the "rest" position shown in FIG. 5 wherein a diaphragm washer 122 is held in contact with a stop shoulder 103 formed to cover 102. The piston 116 and rolling diaphragm 118 cooperate to perform a pressure responsive function whereby the piston rod 101 is movable against the biasing action of the compressed actuator spring 120 and the tension spring 111 in response to the pressure condition supplied to the pressure chamber 100 by way of conduit 92.

The operation of the pressure responsive throttle actuator means in accordance with the invention will now be described. Typically, the parts would be in the "rest" position shown in FIG. 5 wherein the springs 111 and 120 urge the piston rod 110 downwardly with washer 122 in contact with shoulder 103 whereby the throttle shaft 106 maintains the throttle of the engine 32 in an idle position. When the pump 30 is started in operation and starts to build up pressure (approximately 15 to 20 psi) in discharge 54, the rolling diaphragm piston means is urged upwardly against the biasing spring force provided by the springs 111 and 120. Once this spring force is overcome, the rolling diaphragm piston means and piston rod 110 move upwardly to actuate the engine throttle to an open position. If subsequently something occurs to cause the loss of prime or pumping is stopped for some reason, then the pressure in the discharge 54 of the pump 30 is reduced and the piston and rolling diaphragm means is moved back to the lower or "rest" position shown in FIG. 5 by the action of springs 111 and 120 to return the engine to an idle condition.

The block 31 of engine 32 preferably made of aluminum so that it is light in weight. However, aluminum is a good conductor of heat. Accordingly, it is important to cool the block 31 of engine 32 so that it does not get so hot that it would cause melting or other damage to the plastic body of float 10. To this end, there is provided a heat dissipating fin 130 on the casting forming the exhaust pipe 132 of the engine 32. As shown in FIG. 1, the exhaust pipe 132 is secured to the engine by bolts 134 and brackets 136 and extends downwardly from the engine block 31 toward well 20 and turns upwardly to a location above the collar 18 of the float 10 whereat the engine muffler 138 is attached. The fin 130 is cast along the center of the exhaust pipe 132 and has a portion extending therefrom a distance to dip into the well 20 for contact with the water contained therein when the float is in the normal partially submerged floating condition as described above. As shown in FIG. 1, the lower end of the fin 130 extends below the water level "L". By this construction, the fin 130 functions to draw heat by conduction from the exhaust pipe casting.

Figure 7:
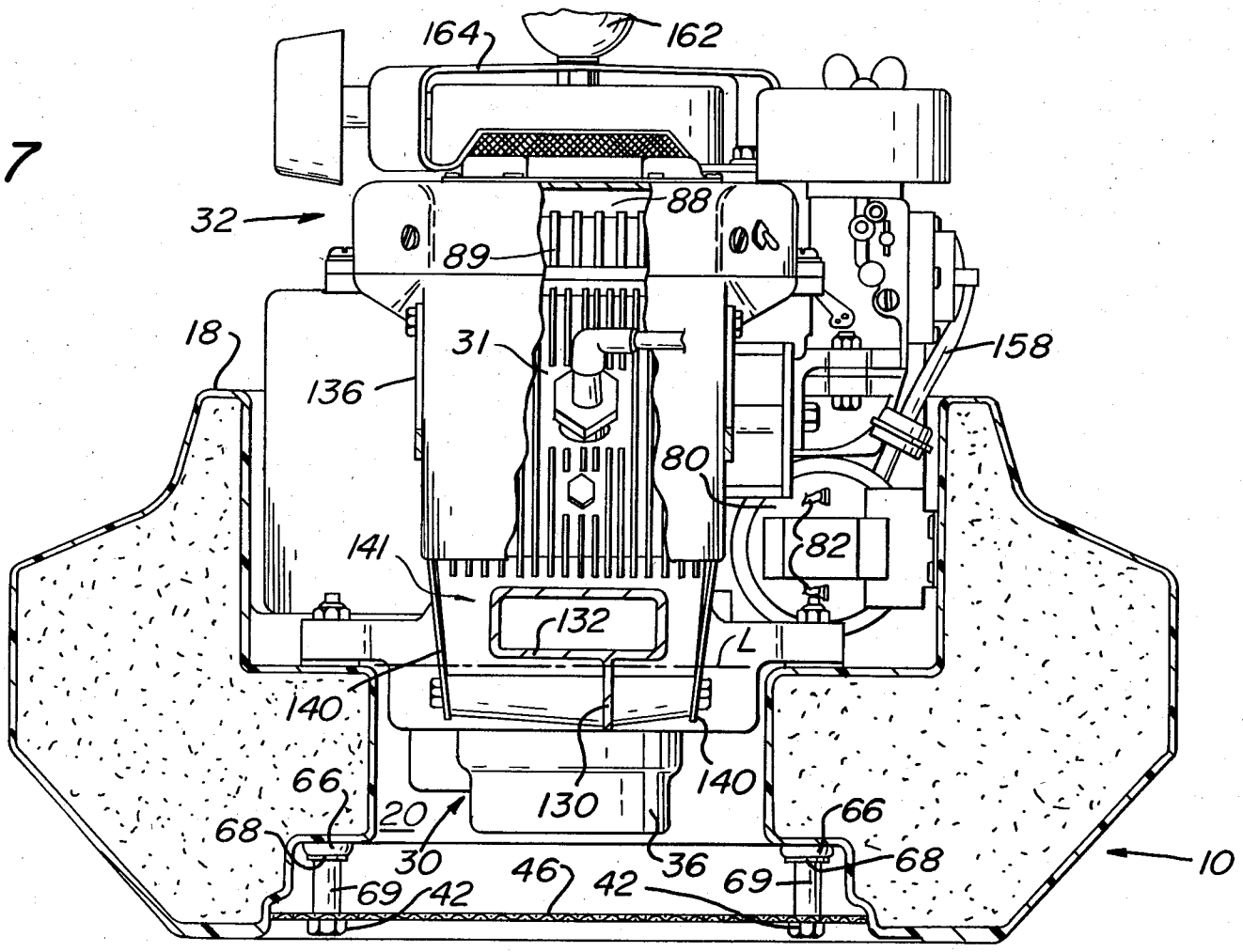
FIG. 7 is a sectional view taken generally on one 7—7 of FIG. 1.

The cooling of the engine block 31 and the engine exhaust pipe 132 is aided by a pair of splash plates 140 which extend downwardly from the engine block 31 so as to dip into water contained in well 20. The plates 140 are spaced apart and are located on each side of the exhaust pipe 132 as shown in FIG. 7. The plates 140 are arranged so that air coming from the hot engine block is shielded from contact with the float 10 and is cooled by passing over the plates 140 which are maintained at a reduced temperature by reason of their being partially submerged in the water in well 20. Moreover, the high velocity air stream which is discharged from the fan chamber 88 passes over the engine block cooling fins and downwardly through the passage 141 defined between plates 140 so as to splash the water in well 20 onto the surface area of the float 10 closest to the exhaust tube 132 to cool this surface area.

The portable pump of the invention also comprises a fuel tank and cap assembly 150 mounted on the float 10 by means of a strap 152 and a mounting bracket 153 as shown in FIG. 1. A fuel hose 154 is connected to the interior of the fuel tank 150 by way of an elbow 156. The fuel hose 154 has a filter 158 connected therein. The engine 32 is provided with a conventional manually-operated starter means 160 for use in starting the engine. Also, a hand knob 162 is mounted at the top of the engine 32 by means of a suitable bracket 164 for use in moving the float 10 into and off of the water.

In FIG. 8 there is shown two outrigger means 180 attached to the float 10 for use in stabilizing the float 10 in rough water conditions. An outrigger means 180 is attached to the float on each side thereof in a manner such that it can be removed if desired. Each outrigger means 180 comprises a rod 182 having one end engaged with a locking member 184 formed on the sidewall of float 10 at a location opposite to a handle 22 and has a bend portion 186 adapted to engage the associated handle 22 as shown in FIG. 8. A float 188 is mounted on the extended end of rod 182. It will be apparent that the mounting arrangement for each outrigger means 180 is such that it can be removably attached in the position shown in FIG. 8 so as to extend in a horizontal direction away from the sidewall portion of the float 10. By this arrangement, the outrigger means 180 on each side of the float 10 is positioned so as to provide extra buoyancy therefor at locations spaced apart therefrom so as to stabilize the float 10 under rough water conditions.

What is claimed is:

1. A floating portable pump comprising:

a float adapted to be supported on a water in a partially submerged floating condition, said float defining a well for containing water, a centrifugal pump having an impeller mounted on a rotatable impeller shaft, a suction inlet, and a pump discharge, means supporting said pump on said float with said impeller shaft extending vertically and with said suction inlet submerged in water in said well when said float is in said partially submerged floating condition, an internal combustion engine arranged to drive said impeller shaft, means securing said pump directly to said engine so that said pump and engine are supported together by said float and in an arrangement such that the engine causes rotation of said impeller to cause said pump to draw water from said well through the suction inlet and discharge water from said pump discharge, said float being a one-piece foam filled structure forming a rim portion and a horizontally extending shelf located internally of said rim portion, said shelf having an opening therein adapted to receive the suction inlet of said pump, said float including a pair of handles molded onto side wall portions thereof, said pump supporting means including a mounting flange supported on the top wall of said shelf and a plurality of shock-absorbing mounting means between said flange and said shelf.

2. A pump according to claim 1 including a pair of outrigger means adapted to be mounted on said float to extend from said side wall portions.

3. A pump according to claim 2, wherein each of said outrigger means includes a rod adapted to removably engage one of said handles and a float mounted on the extended end of said rod.

4. A floating portable pump comprising:

a float adapted to be supported on water in a partially submerged floating condition, said float defining a well for containing water, a centrifugal pump having an impeller mounted on a rotatable impeller shaft, a suction inlet, and a pump discharge, means supporting said pump on said float with said impeller shaft extending vertically and with said suction inlet submerged in water in said well when said float is in said partially submerged floating condition, an internal combustion engine arranged to drive said impeller shaft, means securing said pump directly to said engine so that said pump and engine are supported together by said float and in an arrangement such that the engine causes rotation of said impeller to cause said pump to draw water from said well through the suction inlet and discharge water from said pump discharge, said float being a one-piece foam filled structure forming a rim portion and a horizontally extending shelf located internally of said rim portion, said shelf having an opening therein adapted to receive the suction inlet of said pump, said pump supporting means including a mounting flange supported on the top wall of said shelf and a plurality of shock-absorbing mounting means between said flange and said shelf, said float being provided with a flat surface so that said float can be supported in a vertically extending position when not in use.

5. A pump according to claim 4 wherein said float comprises a splash collar projecting upwardly from said rim portion and extending around said engine and said pump for protecting the electrical parts thereof.

6. A floating portable pump comprising:

a float adapted to be supported on water in a partially submerged floating condition, said float defining a well for containing water, a centrifugal pump having an impeller mounted on a rotatable impeller shaft, a suction inlet, and a pump discharge, means supporting said pump on said float with said impeller shaft extending vertically and with said suction inlet submerged in water in said well when said float is in said partially submerged floating condition, an internal combustion engine arranged to drive said impeller shaft, and means securing said pump directly to said engine so that said pump and engine are supported together by said float and in an arrangement such that the engine causes rotation of said impeller to cause said pump to draw water from said well through the suction inlet and discharge water from said pump discharge, said engine having an engine block made of a light weight metal and mounted at a location above said well, said engine including an exhaust pipe secured to said engine block so as to extend downwardly therefrom and to turn upwardly toward the top end of said float, said exhaust pipe having a heat dissipating fin formed thereon and having a portion extending downwardly from said exhaust pipe to be submerged in the water contained in said well whereby said fin functions to draw heat by conduction from said exhaust pipe to cool the same, and a pair of plates secured to said engine block and extending downwardly therefrom so as to dip into water contained in said well, said plates being spaced apart and located on each side of said exhaust pipe whereby air coming from said engine block is shielded from contact with said float and is cooled by passing over said plates.

7. A floating portable pump comprising:

a float adapted to be supported on water in a partially submerged floating condition, said float defining a well for containing water, a centrifugal pump having an impeller mounted on a rotatable impeller shaft, a suction inlet, and a pump discharge, means supporting said pump on said float with said impeller shaft extending vertically and with said suction inlet submerged in water in said well when said float is in said partially submerged floating condition, an internal combustion engine arranged to drive said impeller shaft and having a throttle means for controlling the engine speed, means securing said pump directly to said engine so that said pump and engine are supported together by said float and in an arrangement such that the engine causes rotation of said impeller to cause said pump to draw water from said well through the suction inlet and discharge water from said pump discharge, means sensing the pressure of the water in said pump discharge, throttle actuator means for actuating said engine throttle means to reduce the engine speed to an idle condition in response to the sensing of a low water pressure condition in said pump discharge by said sensing means, said engine including an ignition circuit for controlling ignition thereof and having a grounding circuit for shutting off the ignition of said engine, and fan means for blowing air in a fan chamber to produce an air pressure condition which increases as the engine speed increases and vice versa, means sensing the air pressure condition in said fan chamber, pressure responsive switch means serially connected in said grounding circuit for controlling the grounding of said ignition circuit, and conduit means connecting said air pressure switch to said fan chamber, said sensing means being responsive to an air pressure condition corresponding to an overspeed condition of said engine for actuating said air switch means to a control position in which said ignition circuit is grounded to cause a reduction in the engine speed.

8. A pump according to claim 7 wherein said throttle actuator means comprises a throttle actuator assembly including a rolling diaphragm piston means, a cover defining a pressure chamber on one side of said rolling diaphragm piston means, a housing defining a piston chamber on the other side of said rolling diaphragm means, said piston chamber being constructed and arranged to accommodate movement of said rolling diaphragm piston means, a piston rod secured to said rolling diaphragm piston means for movement therewith and having an extended end, and means connecting said extended end to said engine throttle means.

9. A pump according to claim 8 wherein said throttle actuator assembly includes a spring means biasing said rolling diaphragm piston means to a rest position when a low pressure condition exists in said pressure chamber whereby said engine throttle means maintains said engine in an idle condition, said rolling diaphragm piston means being responsive to an increase in pressure in said pressure chamber for moving said rolling diaphragm piston means away from said rest position to a throttle actuating position for actuating said throttle means to increase the engine speed.

10. A floating portable pump comprising:

a float adapted to be supported on water in a partially submerged floating condition, said float defining a well for containing water, a centrifugal pump having an impeller mounted on a rotatable impeller shaft, a suction inlet, and a pump discharge, means supporting said pump on said float with said impeller shaft extending vertically and with said suction inlet submerged in water in said well when said float is in said partially submerged floating condition, an internal combustion engine arranged to drive said impeller shaft, means securing said pump directly to said engine so that said pump and engine are supported together by said float and in an arrangement such that the engine causes rotation of said impeller to cause said pump to draw water from said well through the suction inlet and discharge water from said pump discharge, said float having a rim portion and a horizontally extending shelf located internally of said rim portion, said shelf having an opening therein adapted to receive the suction inlet of said pump, said pump having a mounting flange overlying the top wall of said shelf and having a plurality of mounting holes therein, said means for supporting said pump on said float comprising a plurality of shock-absorbing mounting means, each of said mounting means including a vertically extending passage in said shelf means aligned with a mounting hole in said pump flange, a vertically extending bolt means extending through said passage and a corresponding mounting hole in said pump flange for engaging said pump flange at the top end of said bolt means, said vertical passage having an upper enlarged diameter portion at the upper end thereof and a lower enlarged diameter portion at the lower end thereof, an upper resilient member received in said upper enlarged diameter portion and maintained in compression between said pump flange and said upper enlarged diameter portion of said passage, and a lower resilient member received in said lower enlarged diameter portion and maintained in compression between the lower end of said bolt means and said lower enlarged diameter portion of said passage.

11. A pump according to claim 10 including a suction screen mounted on the lower end of said bolt means below said lower resilient members, said bolt means supporting said suction screen to extend across an inlet formed in the bottom end of said float.

12. A pump according to claim 10 wherein said resilient members are made of a soft rubber.

* * * * *